US010658730B2

(12) United States Patent
Wang et al.

(10) Patent No.: US 10,658,730 B2
(45) Date of Patent: May 19, 2020

(54) MULTI-FEEDS METAL COVER ANTENNA FOR GAS DETECTION DEVICES

(71) Applicant: Honeywell International Inc., Morris Plains, NJ (US)

(72) Inventors: Kai Wang, Shanghai (CN); James Liu, Livermore, CA (US); Pengjun Zhao, Shanghai (CN); Juan Kong, Shanghai (CN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/778,473

(22) PCT Filed: Nov. 30, 2015

(86) PCT No.: PCT/CN2015/095931

§ 371 (c)(1),
(2) Date: May 23, 2018

(87) PCT Pub. No.: WO2017/091930

PCT Pub. Date: Jun. 8, 2017

(65) Prior Publication Data

US 2019/0020099 A1 Jan. 17, 2019

(51) Int. Cl.
*H01Q 1/24* (2006.01)
*H01Q 5/335* (2015.01)
(Continued)

(52) U.S. Cl.
CPC ..... *H01Q 1/243* (2013.01); *G08B 21/14* (2013.01); *G08B 25/08* (2013.01); *G08B 25/10* (2013.01);
(Continued)

(58) Field of Classification Search
CPC ..... H01Q 1/243; H01Q 5/335; H01Q 5/314
See application file for complete search history.

(56) References Cited

U.S. PATENT DOCUMENTS

2008/0018541 A1* 1/2008 Pang ..... H01Q 1/243 343/702
2014/0055303 A1* 2/2014 Broemer ..... H01Q 1/243 343/700 MS
2014/0320376 A1 10/2014 Ozdemir

FOREIGN PATENT DOCUMENTS

CN 101662070 A 3/2010
CN 101809813 A 8/2010
(Continued)

OTHER PUBLICATIONS

International Application No. PCT/CN2015/095931, International Search Report, dated Aug. 24, 2016, 4 pages.
(Continued)

*Primary Examiner* — Robert Karacsony
(74) *Attorney, Agent, or Firm* — Wick Phillips Gould & Martin, LLP

(57) ABSTRACT

In an embodiment, an apparatus (e.g., a gas detection device) includes a housing, a printed circuit board (PCB), one or more radio modems with a switching network. The housing includes a conductive cover and the cover plays as an antenna. The PCB may be fixed in the housing and includes a ground plane and a plurality of conductive feeds. Each feed are vertically mounted directly or indirectly on the PCB. When the cover is attached to the housing, each of the feeds electrically contact a respective connection point on the antenna. The switching network is to configure which feed should be connected to the radio modem. A extra grounding resistor is mounted or not to change antenna type to enhance the performance of antenna.

20 Claims, 8 Drawing Sheets

(51) Int. Cl.

| | |
|---|---|
| ***G08B 25/10*** | (2006.01) |
| ***G08B 25/08*** | (2006.01) |
| ***G08B 21/14*** | (2006.01) |
| ***H01Q 9/42*** | (2006.01) |
| *H01Q 9/04* | (2006.01) |

(52) U.S. Cl.

CPC ..... *H01Q 1/24* (2013.01); *H01Q 5/335* (2015.01); *H01Q 9/42* (2013.01); *H01Q 9/04* (2013.01)

(56) References Cited

FOREIGN PATENT DOCUMENTS

| | | | |
|---|---|---|---|
| CN | 103161506 | A | 6/2013 |
| CN | 103928752 | A | 7/2014 |
| WO | 2014149150 | A1 | 9/2014 |
| WO | 2015103257 | A1 | 7/2015 |
| WO | 2017091930 | A1 | 6/2017 |

OTHER PUBLICATIONS

International Application No. PCT/CN2015/095931, Written Opinion of the International Searching Authority, dated Aug. 24, 2016, 4 pages.

* cited by examiner

MULTI-FEEDS METAL COVER ANTENNA FOR GAS DETECTION DEVICES

CROSS-REFERENCE TO RELATED APPLICATIONS

The present application is the National Stags of International Application No. PCT/CN2015/095931 filed on Nov. 30, 2015 and entitled "Multi-Feeds Metal Cover Antenna For Gas Detection Devices" which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Gas detection devices are widely used as safety devices to detect various gases such as hydrogen sulfide, carbon monoxide, oxygen, etc. Such devices may be portable and worn by a human. Further, gas detection sensors may have wireless capability to wirelessly transmit detected gas readings, for example, to a monitoring station. However, some gas detection devices include metal covers. Metal covers unfortunately can act as an electromagnetic shield and thus interfere with the device's ability to send and receive wireless communications.

SUMMARY

In an embodiment, an apparatus includes a housing, a printed circuit board (PCB), a radio modem, and a switching network. The housing includes a conductive cover and the cover includes an antenna. The PCB may be mounted in the housing and includes a ground plane and a plurality of conductive feeds. Each feed protrudes away from the PCB. When the cover is attached to the housing, each of the feeds electrically contact a respective connection point on the antenna. The switching network is coupled to the radio modem and to the plurality of feeds. The switching network is configurable such that when the cover is attached to the housing, a selectable one of the feeds is electrically coupled through the switching network to the radio modem.

Another embodiment is directed to a gas detection device which includes a housing, a gas sensor, a PCB, a radio modem, and a matching network. The housing includes a conductive cover which includes an antenna. The gas sensor is configured to receive an air sample. The PCB may be mounted in the housing and includes a ground plane and a plurality of conductive feeds. Each feed protrudes away from the PCB, and when the cover is attached to the housing, each of the feeds electrically contacts a respective connection point on the antenna. The switching network is provided on the PCB and may be coupled to the radio modem and to the plurality of feeds. The matching network may be coupled between the radio modem and the switching network and may be configured to adjust a resonant frequency of the antenna with respect to at least one of the feeds. The switching network is configurable such that when the cover is attached to the housing, a selectable one of the feeds is electrically coupled through the switching network to the radio modem.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
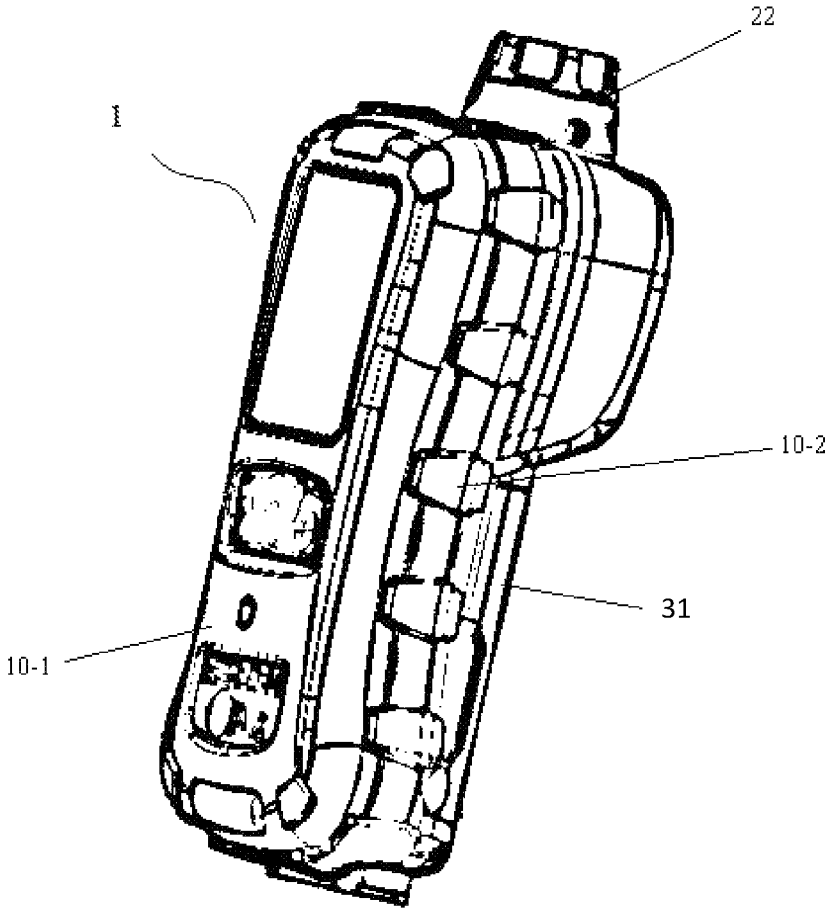
FIG. 1 shows an example of a gas detection device according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following definitions of various terms shall apply throughout this document:

The term "comprising" means "including but not limited to;"

The phrases "in one embodiment," "according to one embodiment," and the like generally mean that the particular feature, structure, or characteristic following the phrase may be included in at least one embodiment, but such features, structure or characteristics may be included in more than one embodiment (i.e., such phrases do not necessarily refer to the same embodiment);

If the specification describes something as "exemplary" or an "example," it should be understood that refers to a non-exclusive example;

The terms "about," approximately" and the like, when used with a number, may mean that specific number, or alternatively, a range in proximity to the specific number, as understood by persons of skill in the art field; and The embodiments described herein are directed to a wireless device which includes a conductive cover (e.g., metal) that is used as the antenna for the wireless modem in the device. The device includes a housing and the cover attaches to the housing. The wireless device can be any type of device. In the embodiments described below, the device is a gas detection device but could perform different functions in other embodiments. The gas detection device includes a printed circuit board (PCB) which includes multiple conductive feeds and a ground plane. A conductive feed may be mounted vertically to the PCB. When the conductive cover is attached the housing, the feeds automatically electrically contact respective connection points on the antenna of the cover. The PCB may include a microcontroller unit (MCU) and one or more radio modem boards which contain a switching network and matching circuitry. The antenna connects to the radio modem board through the switching network and one of the feeds. The switching network on the modem can be configured such that when the cover is attached to the housing, a selectable one of the feeds is electrically connected through the switching network to the radio modem's chips. Each feed may be provided at different location on the antenna to thereby cause the antenna to resonate at different frequencies. In some examples, a feed can cause three resonant frequencies which may cover most or all of the ISM bands. In other examples, a feed can cause two resonant frequencies to cover part of the ISM bands, while in another example a feed can cause one resonant frequency to cover one of the ISM bands. Thus, by configuring the switching network to connect the modem to a different suitable feed whose resonant frequency can cover the modem's working band and providing the feed at certain locations on the antenna, the desired frequency bands for communications for the device may be obtained. The gas detection device can wirelessly send and receive data at any one of multiple desired frequencies. The frequencies can be whatever is desired for the user of the gas detection device. Examples include the Industrial, Scientific and Medical (ISM) band, GPS, WiFi, Zigbee, Bluetooth Low Energy (BLE), and so on.

FIG. 1 shows an example of a gas detection device 1 in accordance with various embodiments. The gas detection device 1 in the example of FIG. 1 is a portable, battery device and includes a housing comprising various structural components. One of the components is a conductive cover 10-1. The conductive cover 10-1 may cover the front of the device (i.e., the portion facing the user during use). Some or all of the cover 10-1 is conductive (e.g., aluminum or other metal). The housing also may include a rear structural component and various other elements 10-2. At the top of the gas detection device 1 is a pump 22 which assists to draw an air sample into the device to thereby accelerate gas collection. A battery 31 may be attached to the rear of the device.

Figure 2:
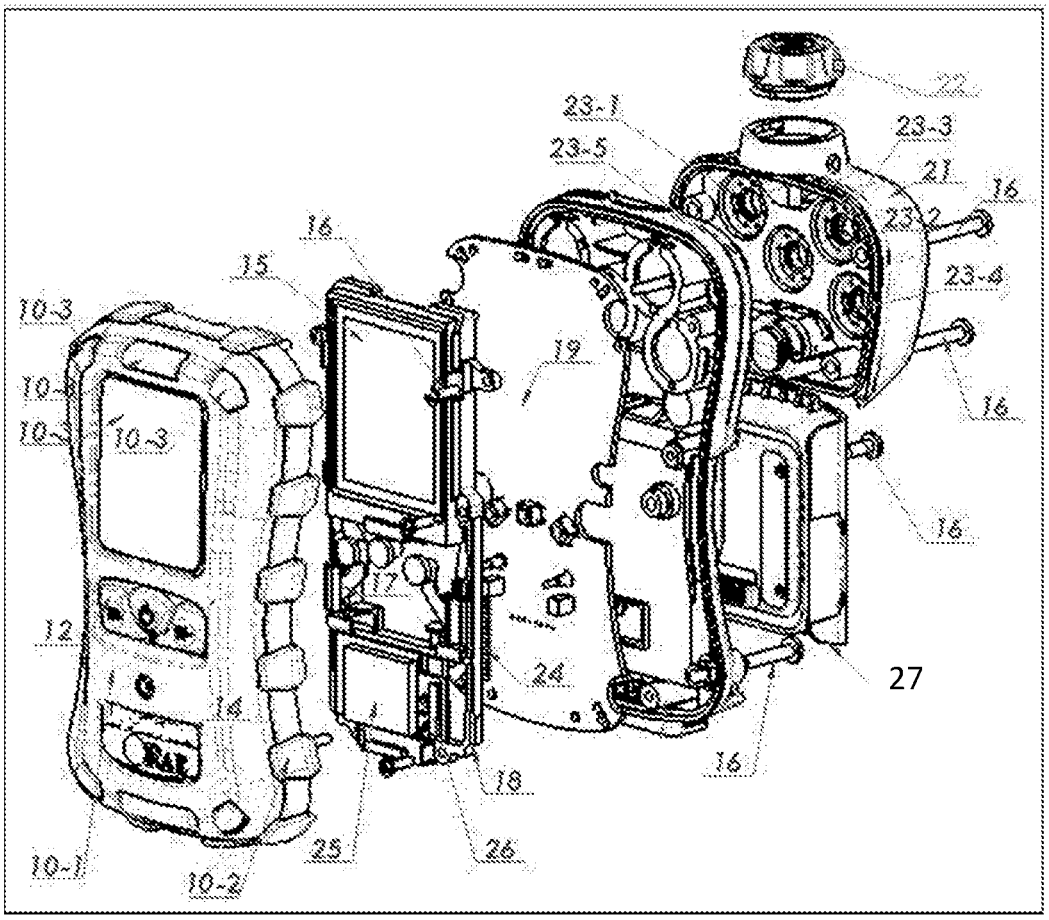
FIG. 2 shows an exploded view of the gas detection device of FIG. 1 according to an embodiment.
Figure 3:
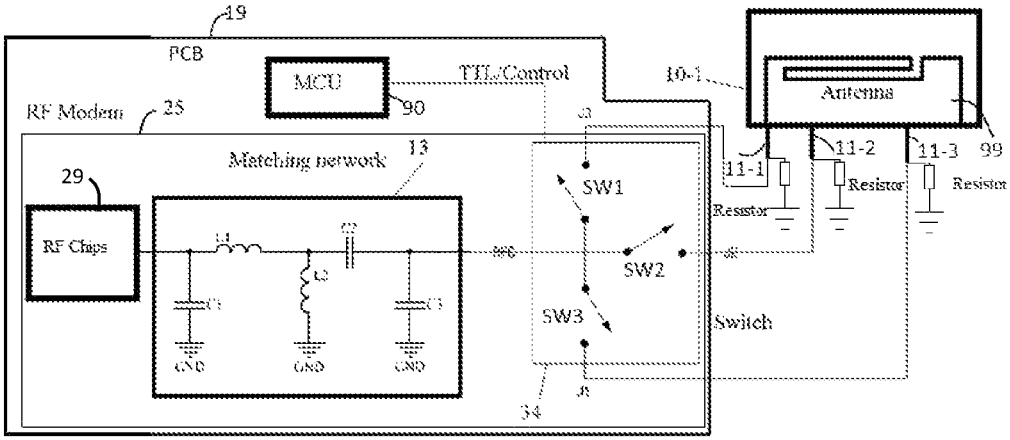
FIG. 3 shows a circuit block diagram of the gas des detection device of FIG. 1 and including multiple feeds to an antenna formed as part of the device's conductive cover according to an embodiment.

FIG. 2 shows an exploded view of the gas detection device 1. A front housing 12 is shown which includes the conductive cover 10-1 and various other structural and/or aesthetic components 10-2 and 10-3. A rear structural component 21 includes one or more gas sensors 23-1, 23-2, 23-3, 23-4, and 23-5. Each gas sensor may be sensitive to a different gas compound such as carbon monoxide, oxygen, hydrogen sulfide, etc. Assembling screws 16 are used to screw the housing components together. Once screwed together, the housing components sandwich an electronics assembly 26 and a PCB 19. The PCB 19 includes circuitry and feeds (not shown in FIG. 2) and one or more wireless modems. The example of FIG. 3 shows one RF modem board 25, but additional modem boards can be included and/or multiple radio frequency (RF) chip sets can be mounted on a single modem board. The RF modem board and/or the RF chip sets contained thereon may be referred to as the "modem." The electronics assembly 26 includes a display (e.g., a liquid crystal display). Attachment clips 17 and 18 help secure the electronics assembly to the housing.

FIG. 3 shows an example of a block diagram of at least some of the electronics included in the gas detection device 1. The electronics shown include the PCB 19 coupled to an antenna 99 formed on or comprising part of the conductive cover 10-1. The PCB 19 includes a microcontroller unit (MCU) 90 and the RF modem board 25. The RF modem board 25 includes an RF chip set 29, a matching network 13, and a switching network 34. The matching network 13 may comprise one or more electrical components such as resistors, capacitors, and inductors and functions to tune the resonant frequency of antenna 99 as desired. The example matching network 13 in FIG. 3 includes three capacitors C1, C2, and C3 and two inductors L1 and L2 configured as shown, although other collections of electrical components and configurations are possible as well.

The switching network 34 may comprise solid state switches (e.g., field effect transistors) that can be controlled by control signals from the MCU 90. In the example of FIG. 3, the switching network 34 includes three single pole single throw (SPST) switches SW1, SW 2, and SW3. In embodiments in which two feeds can cause resonant frequencies that cover all frequency bands of interest, then two switches will suffice. The switching network 34 otherwise may include a single pole, three switch to connect to all the three feeds. The switches connect to feeds 11-1, 11-2, and 11-3 which in turn connect to the antenna 99. Switch SW1 connects to feed 11-1. Switch SW2 connects to feed 11-2. Switch SW3 connects to feed 11-3. Each switch also connects to a common node of the matching network 13, and thus through the matching network 13 to RF chip set 29 of the radio modem board 25. As such, the RF chips of the modem can be connected to any of the multiple antenna feeds (e.g., feeds 11-1, 11-2, and 11-3).

The conductive cover 10-1 may satisfy the quarter-wave antenna resonance condition to thereby be usable as an antenna. As such, the antenna formed from the cover may have a fixed shape and size in order to keep the resonant frequencies of the antenna relative fixed. As noted above, antenna 99 is formed as part of or on conductive cover 10-1 thereby multipurposing cover 10-1 to provide structural support for the gas detection device 1 as well as functioning as an antenna for the device's wireless capability. In the example of FIG. 3, the antenna 99 may be a patch antenna or formed as a monopole antenna, but there may be a grounding resistor for every feed as shown in FIG. 3. In such a configuration, the antenna will be a IFA or PIFA antenna. If the grounding resistors are not present, the antenna may comprise a patch or monopole antenna. The performance of the antenna of these various types will be different, and the resistors may or may not be included so as to enhance the antenna performance. One or more feeds may be connected to different locations on the antenna 99 when the cover 10-1 is attached to the housing. In the example of FIG. 3, three feeds 11-1, 2, 3 are shown and connected to three different locations on the antenna.

Figure 4:
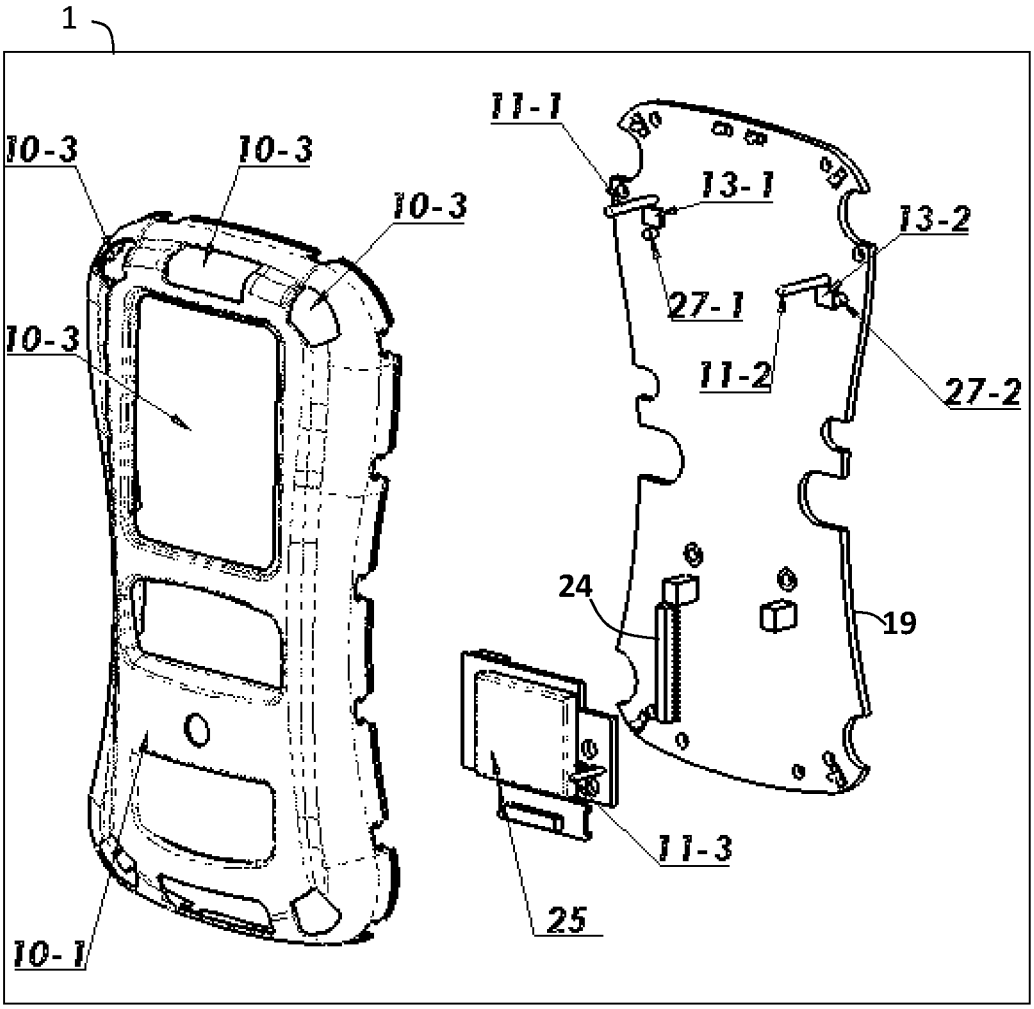
FIG. 4 shows a partial exploded view of the gas detection device illustrating the feeds according to an embodiment.

FIG. 4 shows a partially exploded view of the gas detection device 1. In this view, the conductive cover 10-1, PCB 19, and radio modem 25 are shown. The radio modem 25 is provided on an assembly that mounts on the PCB 19 by way of connector 24. The radio modem assembly itself includes one of the conductive feeds (11-3 in this example). The other two feeds 11-1 and 11-2 are provided on the PCB 19. Because the radio modem 25 is mounted to the PCB 19 through connector 24, feed 11-3 is mounted on the PCB 19 as do feeds 11-1 and 11-2. When the cover 10-1 is attached to the housing and the gas detection device is generally assembled together, the conductive feeds 11-1, 11-2, and 11-3 automatically connect to a respective connection point on the antenna as was shown in the example of FIG. 3. It is also available to add extra matching network 27-1 and 27-2 for feed 2 and feed 3 for better antenna performance.

Figure 5:
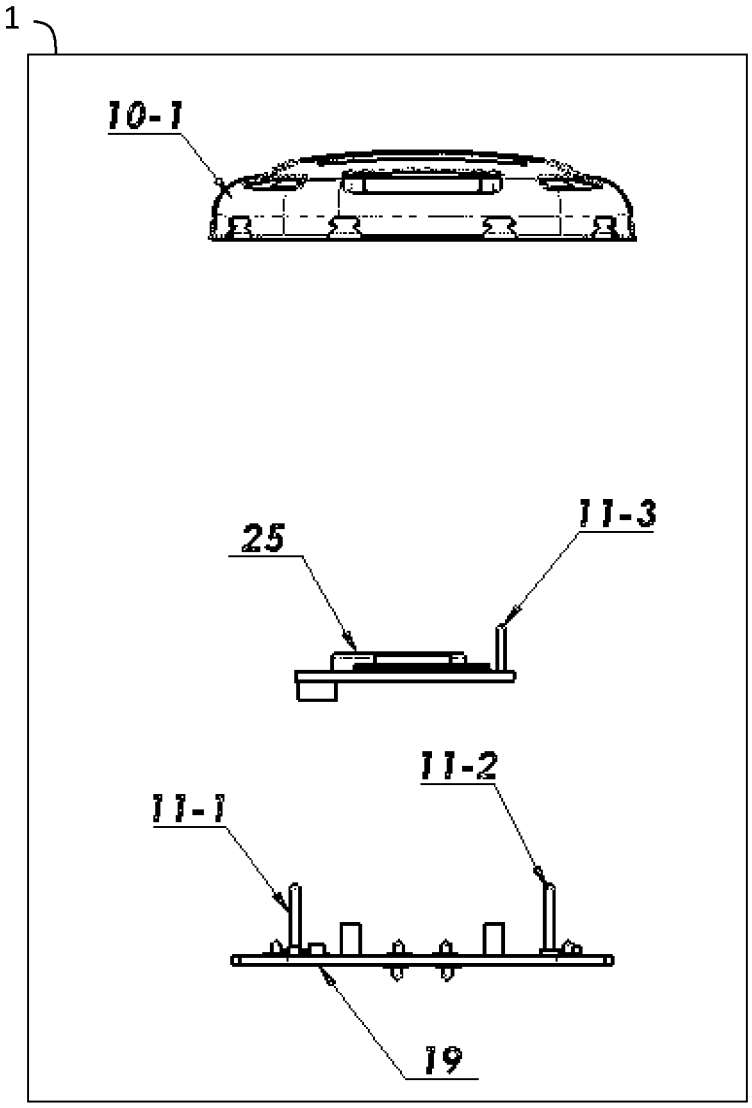
FIG. 5 shows a top-down partial exploded view of the gas detection device illustrating the feeds according to an embodiment.

FIG. 5 shows a top-down partial exploded view of the gas detection device 1. The PCB 19, the radio modem assembly including the radio modem board 25 and three feeds 11-1, 11-2, and 11-3 also are shown. When these components are mated together. The feeds 11-1, 11-2, and 11-3 contact portions of the antenna 99 which is formed or otherwise provided on the inside surface of the conductive cover 10-1.

Figure 6:
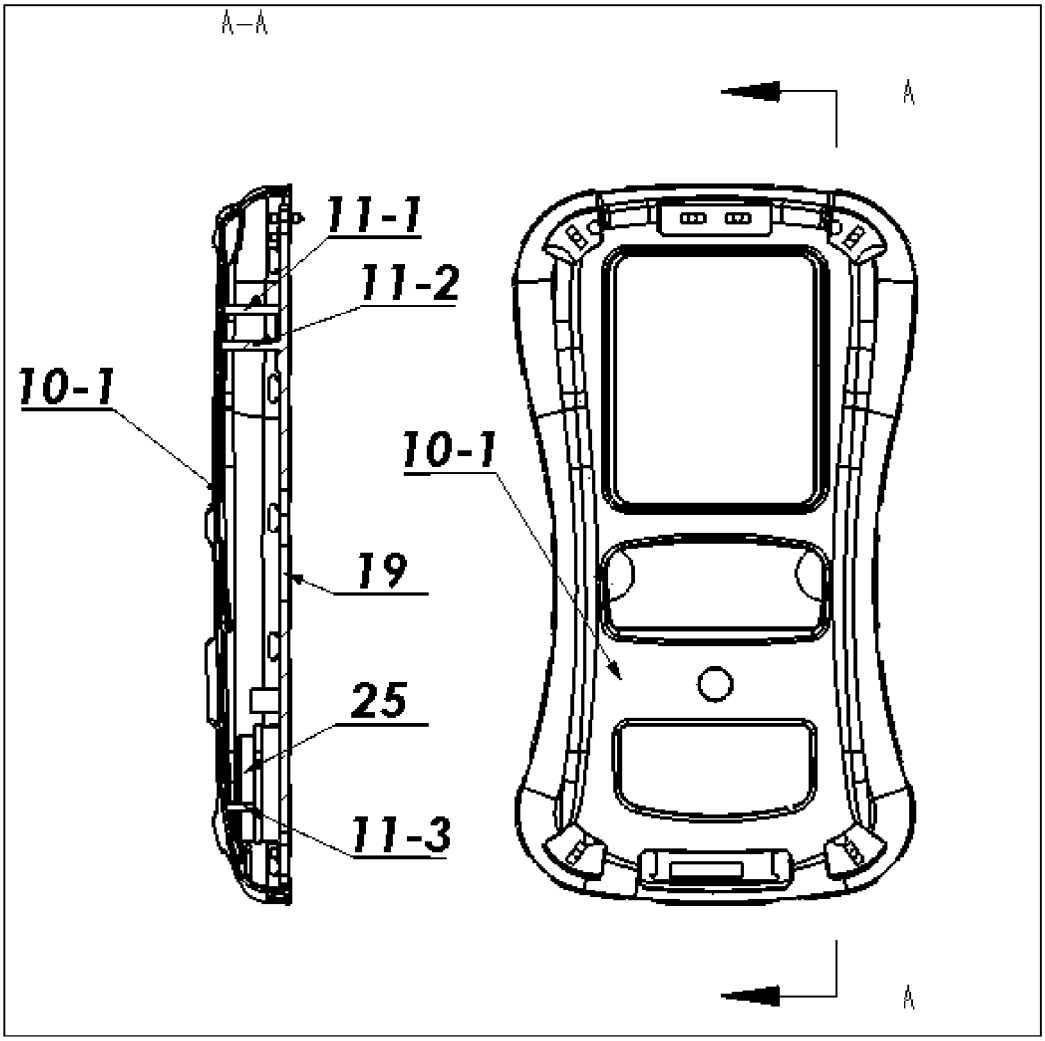
FIG. 6 shows side and front views of the cover of the gas detection device with a printed circuit board providing feeds to the antenna according to an embodiment.

FIG. 6 shows side and front views of the cover 10-1 with PCB 19 attached thereto. The feeds 11-1, 11-2, and 11-3 also are shown mounted vertically from the plane defined by the PCB 19 towards and touching the antenna (not specifically shown) on the inside surface of the conductive cover 10-1.

Figure 7:
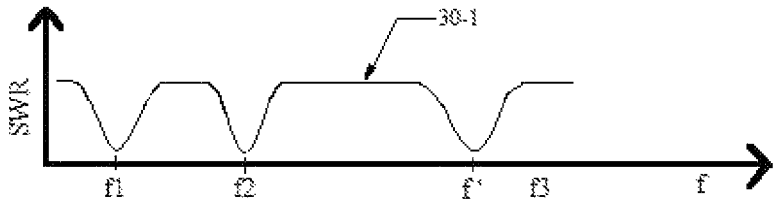
FIG. 7 illustrates an example of resonant frequencies made possible by every feed positioned at various locations according to an embodiment.
Figure 8:
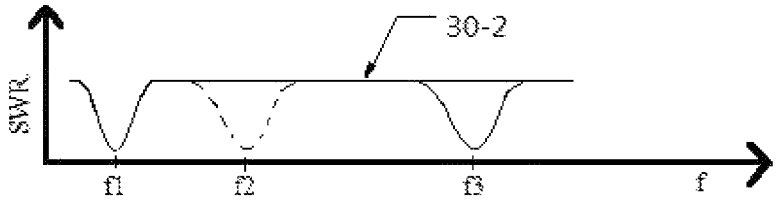
FIG. 8 shows another example of resonant frequencies made possible by every feed positioned at different locations on the antenna according to an embodiment.
Figure 9:
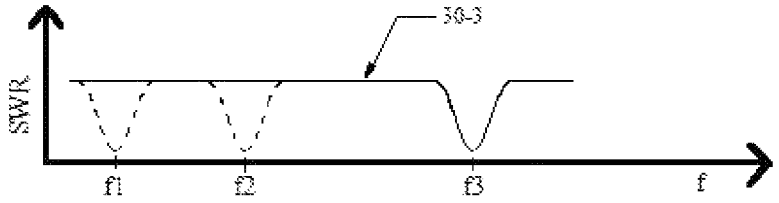
FIG. 9 shows yet another example of resonant frequencies made possible by every feed positioned other antenna locations according to an embodiment.

FIGS. 7, 8, and 9 illustrate three examples of antenna frequency spectra for three different placement locations of feeds 11-1, 11-2, and 11-3. These examples show curves of standing wave ratio (SWR) versus frequency. In the example of FIG. 7, three resonant frequencies are possible, while only two resonant frequencies are obtained from particular feed placements as illustrated in FIG. 8, and only one resonant frequency is possible from a particular feed placement as illustrated in FIG. 9.

Figure 10:
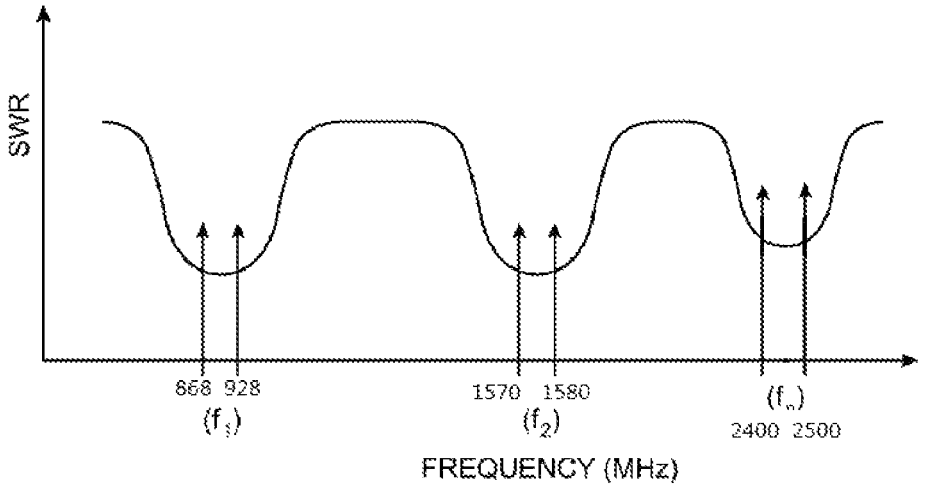
FIG. 10 illustrates an example of a specific set of resonant frequency bands inspired possible by the feeds whatever which feed to an embodiment.

FIG. 10 illustrates a particular example in which three resonant frequencies are made possible by a particular placement of the three feeds 11-1, 11-2, and 11-3. One resonant frequency is from 868 MHz to 928 MHz. Another resonant frequency is from 1570 MHz to 1580 MHz. A third resonant frequency is from 2400 MHz to 2500 MHz.

Figure 11:
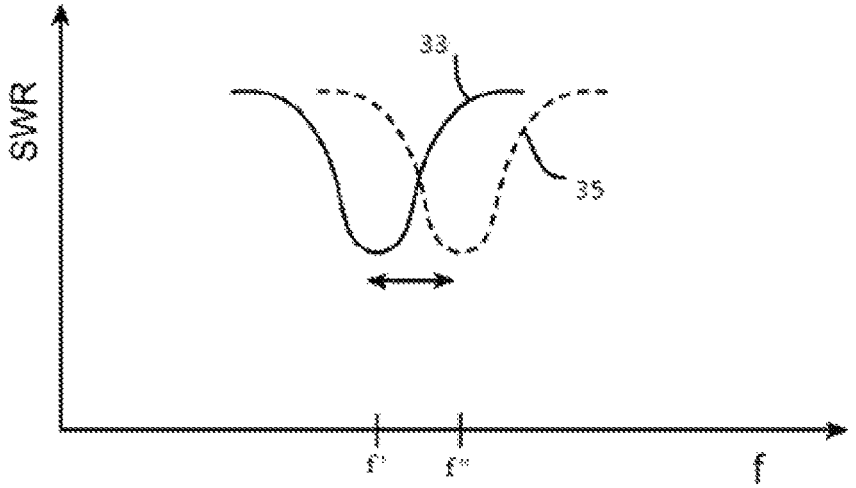
FIG. 11 illustrates that a resonant frequency can be adjusted through use of the matching network according and the Grounding resistor directly connected to the feed, or be adjusted through change the feed by the switching network on the RF modem to an embodiment.

FIG. 11 illustrates that a particular resonant frequency can be adjusted (increased or decreased) through the use of a suitable matching network or through the grounding resistor and through change feed by switching network. In FIG. 11, a resonant frequency for curve 33 is shown adjusted upward as curve 35.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Further, a description of a technology in the "Background" is not to be construed as an admission that certain technology is prior art to any invention(s) in this disclosure.

While several embodiments have been provided in the present disclosure, it should be understood that the disclosed systems and methods may be embodied in many other specific forms without departing from the spirit or scope of the present disclosure. The disclosed embodiments are to be considered as illustrative and not restrictive, and the claims are not necessarily to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An apparatus, comprising:

a housing including a conductive cover configured to function as an antenna;

a printed circuit board (PCB) mounted in the housing and including a ground plane and at least first and second conductive feeds, wherein each of the at least first and second conductive feeds is attached to and protrudes away from the PCB, and wherein when the cover is attached to the housing, each of the at least first and second conductive feeds electrically contact a respective connection point on the antenna;

a radio modem including a third conductive feed mounted on the PCB; and a switching network mounted on the PCB and coupled to the third conductive feed of the radio modem and to the at least first and second conductive feeds;

wherein the switching network is configurable such that when the cover is attached to the housing, a selectable one of the first, second, or third conductive feeds is electrically coupled through the switching network to the radio modem.

2. The apparatus of claim 1, further comprising one or more gas sensors, wherein the apparatus is a gas detection device.

3. The apparatus of claim 1, wherein each of the at least first and second conductive feeds comprises a conductive post that protrudes away from a plane defined by the PCB at an orthogonal angle.

4. The apparatus of claim 1, wherein the switching network includes a plurality of single pole single throw solid state switches.

5. The apparatus of claim 1, further including a microcontroller unit (MCU) coupled to the switching network and operable to configure the switching network to selectively couple a particular one of the first, second, or third conductive feed to the radio modem.

6. The apparatus of claim 1, further including a matching network coupled between the switching network and the radio modem and configured to adjust a resonant frequency of the antenna with respect to at least one of the first, second, and third conductive feeds.

7. The apparatus of claim 1, wherein the switching network is configured to connect the radio modem to a different suitable feed whose resonant frequency can cover the radio modem's working band.

8. The apparatus of claim 1, wherein each of the first, second, and third conductive feeds is provided at a different location on the antenna to thereby cause the antenna to resonate at different frequencies.

9. The apparatus of claim 1, wherein the antenna is connected to the radio modem through the switching network and one of the first, second, or third conductive feeds.

10. A gas detection device, comprising:

a housing including a conductive cover, wherein the conductive cover includes an antenna;

a gas sensor configured to receive an air sample;

a printed circuit board (PCB) mounted in the housing and including a ground plane, a first conductive feed and a second conductive feed, wherein each of the first and second conductive feeds protrudes away from the PCB, and wherein when the cover is attached to the housing, each of the first and second conductive feeds electrically contact a respective connection point on the antenna;

a radio modem including a third conductive feed, where in the radio modem is mounted on the PCB;

a switching network mounted on the PCB and coupled to the radio modem and to the first second, and third conductive feeds; and a matching network coupled between the radio modem and the switching network and configured to adjust a resonant frequency of the antenna with respect to at least one of the first, second, and third conductive feeds;

wherein the switching network is configurable such that when the cover is attached to the housing, a selectable one of the first, second, or third conductive feeds is electrically coupled through the switching network to the radio modem.

11. The gas detection device of claim 10, wherein each of the first and second conductive feeds comprises a conductive post that protrudes away from a plane defined by the PCB at an orthogonal angle.

12. The gas detection device of claim 10, further including a microcontroller unit (MCU) coupled to the switching network and operable to configure the switching network to selectively couple a particular one of the first, second, or third conductive feeds to the radio modem.

13. The gas detection device of claim 10, wherein the switching network includes a plurality of single pole single throw solid state switches.

14. The gas detection device of claim 10, wherein each of the first, second, and third conductive feeds is provided at a different location on the antenna to thereby cause the antenna to resonate at different frequencies.

15. A method for assembling a gas detection device, the method comprising:

attaching a conductive cover to a housing of the gas detection device;

using the conductive cover as an antenna for a wireless modem of the gas detection device;

connecting the conductive cover to at least one of a first, second, or third conductive feed, wherein the first and the second conductive feed are disposed on a printed circuit board and a third conductive feed is disposed on the wireless modem; and configuring a switching network on the wireless modem such that when the cover is attached to the housing, a selectable one of the first, second, or third conductive feeds is electrically connected through the switching network to the wireless modem.

16. The method of claim 15, further comprising connecting the antenna to the wireless modem through the switching network and one of the first, second, or third conductive feeds.

17. The method of claim 15, wherein attaching the conductive cover to the housing further comprises automatically electrically contacting the first, second, and third conductive feeds to respective connection points on the antenna of the conductive cover.

18. The method of claim 15, wherein each of the first, second, and third conductive feeds is provided at a different location on the antenna to thereby cause the antenna to resonate at different frequencies.

19. The method of claim 18, wherein configuring the switching network further comprises configuring the switching network to connect the wireless modem to one of the first, second or third conductive feeds whose resonant frequency can cover the wireless modem's working band, and providing the first, second, and third conductive feeds at certain locations on the antenna, and obtaining the desired frequency bands for communications for the gas detection device.

20. The method of claim 15, further comprising configuring, by a microcontroller unit (MCU) coupled to the switching network, the switching network to selectively couple a particular one of the first, second, or third conductive feeds to the wireless modem.

* * * * *